US006592037B1

(12) United States Patent
Clancy

(10) Patent No.: US 6,592,037 B1
(45) Date of Patent: Jul. 15, 2003

(54) METHOD AND DEVICE FOR THE DETECTION AND DEACTIVATION OF A DEACTIVATABLE SECURITY ELEMENT

(75) Inventor: Terence Clancy, Bensheim-Zell (DE)

(73) Assignee: Meto International GmbH, Hirschhorn (DE)

( * ) Notice: Subject to any disclaimer, the term of this patent is extended or adjusted under 35 U.S.C. 154(b) by 0 days.

(21) Appl. No.: 09/154,465

(22) Filed: Sep. 16, 1998

(30) Foreign Application Priority Data

Sep. 16, 1997 (DE) ..... 197 40 871

(51) Int. Cl.[7] ..... G06K 7/10
(52) U.S. Cl. ..... 235/462.13; 235/383
(58) Field of Search ..... 235/383, 385, 235/462.13; 705/21, 16, 22; 340/572.1, 571

(56) References Cited

U.S. PATENT DOCUMENTS

| | | | | | |
|---|---|---|---|---|---|
| 3,624,631 | A | * | 11/1971 | Chomet et al. | 340/280 |
| 5,059,951 | A | | 10/1991 | Kaltner | 340/572 |
| 5,151,684 | A | | 9/1992 | Johnson | 340/572 |
| 5,245,317 | A | * | 9/1993 | Chidley et al. | 340/571 |
| 5,477,219 | A | * | 12/1995 | Zarembo et al. | 340/572 |
| 5,534,836 | A | * | 7/1996 | Schenkel et al. | 340/572 |
| 5,574,431 | A | * | 11/1996 | McKeown et al. | 340/572 |
| 5,587,703 | A | * | 12/1996 | Dumont | 340/572 |
| 5,594,228 | A | * | 1/1997 | Swartz et al. | 235/383 |
| 5,640,002 | A | * | 6/1997 | Ruppert et al. | 235/472 |
| 5,705,986 | A | * | 1/1998 | Zschirnt | 340/572 |
| 5,777,884 | A | * | 7/1998 | Belka et al. | 235/381 |
| 5,781,111 | A | * | 7/1998 | Easter et al. | 340/572 |
| 5,814,799 | A | * | 9/1998 | Swartz et al. | 235/383 |
| 5,990,794 | A | * | 11/1999 | Alicot et al. | 340/573.1 |

FOREIGN PATENT DOCUMENTS

| | | | |
|---|---|---|---|
| DE | 29611156 U1 | | 10/1996 |
| EP | 0112493 A1 | | 7/1984 |
| EP | 0112493 B1 | | 3/1987 |
| EP | 0 355 355 | * | 2/1990 |
| EP | 0448536 A2 | | 9/1991 |
| EP | 0448536 A3 | | 9/1991 |
| EP | 0499582 A1 | | 8/1992 |
| EP | 0601506 A1 | | 6/1994 |
| FR | 2669756 | * | 5/1992 |
| GB | 2286275 | | 8/1995 |
| WO | WO 87/04282 | | 7/1987 |
| WO | WO 90/00785 | | 1/1990 |
| WO | WO 90/05968 | | 5/1990 |

OTHER PUBLICATIONS

Search Report—EPO 915 439 A3.

* cited by examiner

*Primary Examiner*—Diane I. Lee
(74) *Attorney, Agent, or Firm*—Jones, Tullar & Cooper, P.C.

(57) ABSTRACT

The present invention is directed to a method and a device for the detection and deactivation of a deactivatable security element fitted in or affixed to an article for the purpose of electronic article surveillance. A code is allocated to each article, the code is read in or entered at an input device, an article information is allocated to the code, the article information containing an indication as to whether the article is protected agianst pilferage by an electronic security element, and that a deactivation unit is switched on when the presence of a corresponding indication is established.

7 Claims, 3 Drawing Sheets

METHOD AND DEVICE FOR THE DETECTION AND DEACTIVATION OF A DEACTIVATABLE SECURITY ELEMENT

FIELD OF THE INVENTION

The present invention relates to a method and a device for the detection and deactivation of a deactivatable security element fitted in or affixed to an article for the purpose of electronic article surveillance.

BACKGROUND OF THE INVENTION

More and more articles in department stores and warehouses are being equipped with electronically deactivatable security elements. Security elements of this type are known from German Patent DE 44 36 974 A1, and European Patents EP 0 412 137 and EP 0 181 327 B1, for example. Deactivation takes place as soon as a customer rightly acquires the article by purchase. With the rate of deactivation being less than 100 percent, so-called reminders are arranged in the area of the cash desk to notify the salesperson when a security element has not been deactivated. Like the deactivators, however, these reminders are also blessed with only a certain rate of success, meaning that both contribute cumulatively to an actual rate of deactivation that fails to comply with the desired deactivation rate of 100 percent.

SUMMARY OF THE INVENTION

It is an object of the present invention to provide a method and a device which greatly improve the rate of deactivation.

This object is accomplished with respect to the method aspect by allocating a code to each article, by reading in or entering the code at an input device, by allocating an article information to the code, which article information contains an indication as to whether the article is protected against pilferage by an electronic security element, and by having a deactivation unit switched on when the presence of a corresponding indication is established.

With respect to the device aspect, the object of the present invention is accomplished by allocating a code to each article, by providing an input device at which the code is entered or read in, by providing a processor which allocates to the code an article information saved in a storage unit and detects from the information whether the article is equipped with an electronically detectable security element, and by providing a deactivation unit which is switched on when the processor detects that the article is equipped with an electronically detectable security element.

In accordance with an advantageous further aspect of the device aspect of the present invention provision is made for the security element to be an electromagnetic strip security element, a Barkhausen security element, a thin-film security element, a resonant frequency security element or an acousto-magnetic security element. Basically the device according to the present invention is thus capable of detecting and deactivating all known types of security elements. In this connection it is necessary for the article information allocated to the code to include an indication as to the type of security element with which the article in question is equipped.

If, as proposed in an advantageous aspect of the device aspect of the present invention, several types of deactivator for deactivating the various types of security element are provided in the deactivation unit, the processor activates selectively the deactivator required in the particular case.

Considering that nowadays the article information is called up at cash desks directly via a barcode, it is advantageous for the code to be a barcode. A barcode reader is then used accordingly as an input device. Alternatively, the code can also be a price information and the input device a cash register.

The present invention will be described in more detail in the following with reference to the accompanying drawing.

DESCRIPTION OF THE PREFERRED EMBODIMENT

Figure 1:
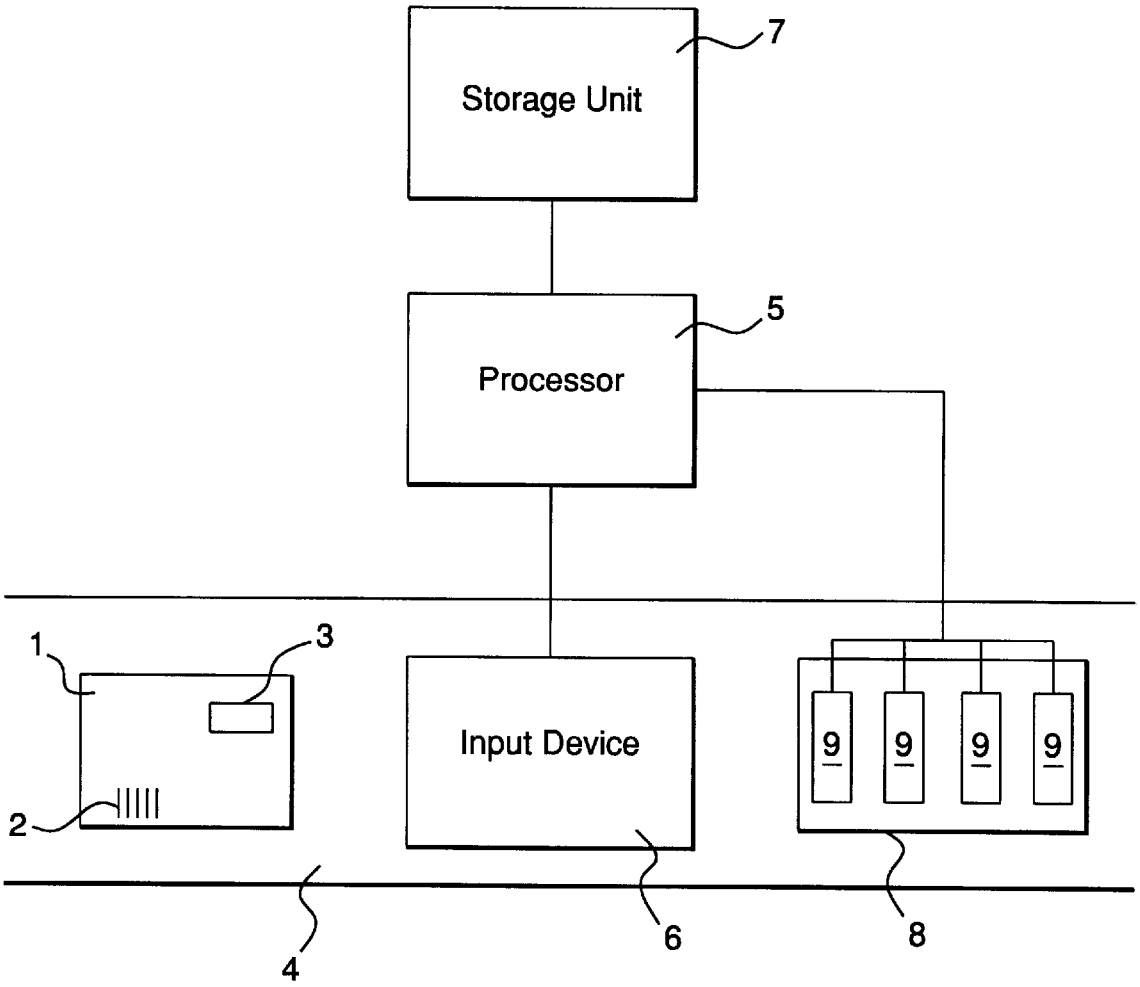
FIG. 1 is a schematic presentation of the device aspect of the present invention.

FIG. 1 shows a schematic presentation of the device of the present invention. The article 1 equipped with a code 2, which in this case is a barcode, is transported by a conveyor belt 4 to the actual cash desk. An input device 6, which in this case is a barcode reader, is arranged in the area of the conveyor belt 4 to read in the barcode 2 and to send the barcode information to a processor 5.

A storage unit 7 is allocated to the processor 5. Article information for each barcode is saved in this storage unit 7. This information includes, among other items, price information and an indication as to whether the article is protected against pilferage by an electronic security element. Where applicable, the storage unit 7 also contains information about the type of security element 3. As soon as the processor 5 detects from the information that the article 1 is protected electronically, it activates the deactivation unit 8, which in the case shown is comprised of several deactivators 9 suited to match the various types of security element 3.

Use of the method and the device according to the present invention thus makes the reminder superfluous. The result is not only a more economical solution but also a significantly higher rate of deactivation because it enables the reminder, as a factor adversely affecting the rate of deactivation, to be eliminated completely.

Figure 2:
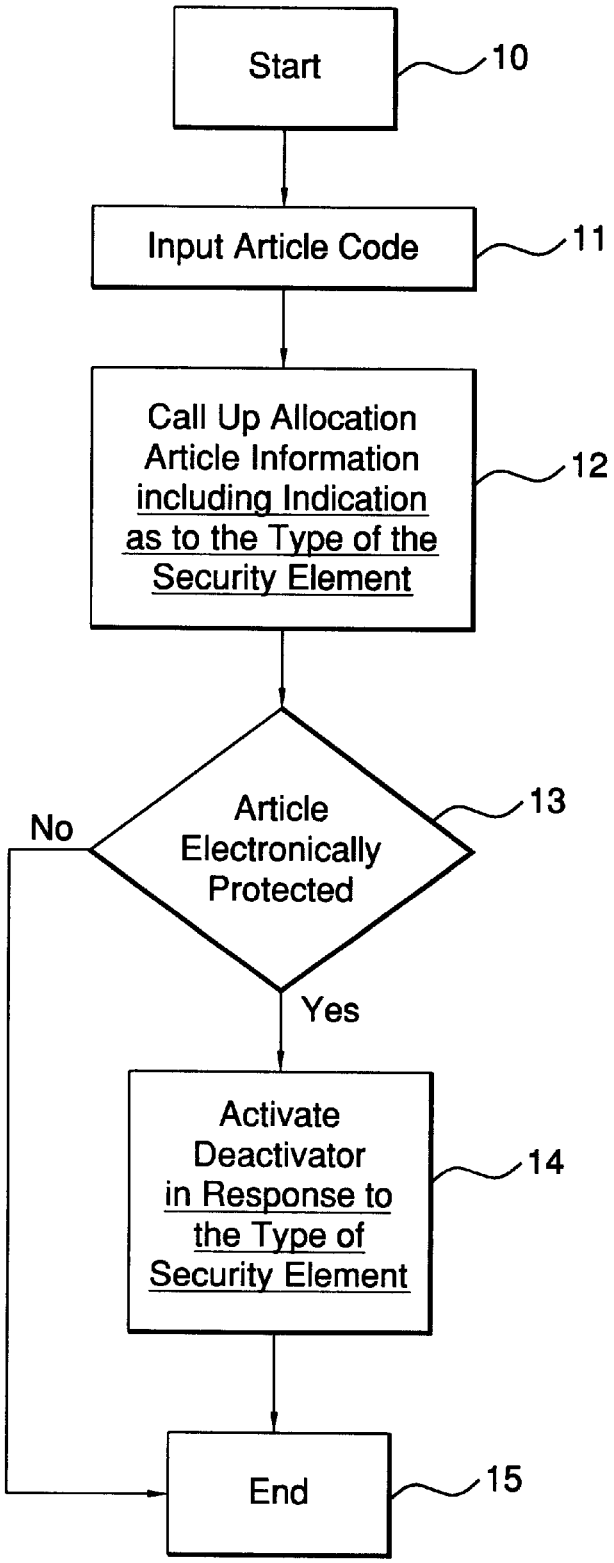
FIG. 2 is the flowchart of a control routine for the processor.

FIG. 2 shows the flowchart of a control routine for the processor 5. After the routine is started at point 10, the code 2 allocated to the article 1 is entered at point 11. The article information allocated to the code 2 is called up at point 12. The article information is used to check whether the article 1 is equipped with a security element 3 for the purpose of electronic article surveillance. If it is not, the routine proceeds to point 15; the routine is then ended. If; on the other hand, the article 1 is equipped with a security element 3, the corresponding deactivator 9 of the deactivation unit 8 will be activated at point 13 of the routine. The routine is then ended at point 15.

Figure 3A:
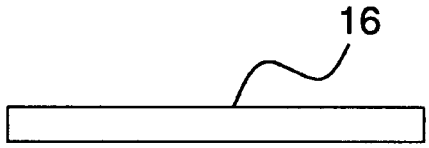
FIG. 3*a* shows a top view of an electromagnetic strip.
Figure 3B:
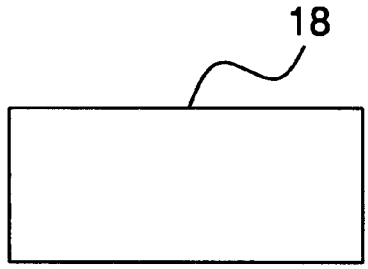
FIG. 3*b* shows a top view of a thin-film element.
Figure 3C:
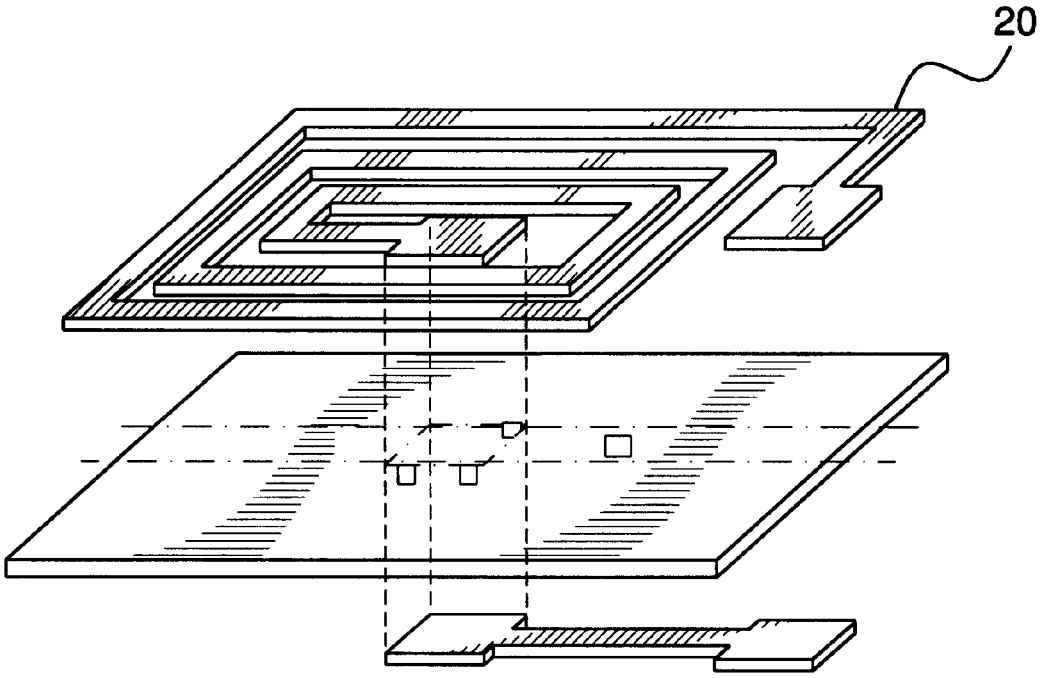
FIG. 3*c* shows a perspective view of a resonant frequency element.

FIG. 3*a* shows an example of an electromagnetic strip 16, while FIG. 3*b* shows an example of a thin-film element 18. FIG. 3*c* shows a resonant frequency element 2.

What is claimed is:

1. A device for a detection and deactivation of a deactivatable security element associated with an article, the article having a code provided with article information, comprising:

an input device which reads the code provided with the article, said article information provided with the code includes an indication as to whether the subject article is protected against pilferage by an electronic security element;

a processor for receiving the information in the code read by said input device, said processor including a storage unit for storing the information received; and a deactivation unit which receives an input from said processor when the information indicates that the article is protected electronically by the electronic security element, and is switched on by the input received;

wherein said deactivation unit includes a plurality of types of deactivators for deactivating various types of security elements, and wherein said processor activates a selective one of said deactivators in response to the type of security element.

2. A device for the detection and deactivation of a deactivatable security element associated with an article, the article having a code provided with article information, comprising:

an input device which reads the code provided with the article, said article information provided with the code includes an indication as to whether the subject article is protected against pilferage by an electronic security element and as to the type of security element with which the subject article is equipped;

a processor for receiving the information in the code read by said input device, said processor including a storage unit for storing the information received; and a deactivation unit which receives an input from said processor when the information indicates that the article is protected electronically by the electronic security element, and is switched on by the input received in response to the type of security element.

3. The device as defined in claim 2, wherein the security element is one of an electromagnetic strip, a Barkhausen element, a thin-film element, a resonant frequency element, and acousto-magnetic element.

4. The device as defined in claim 2, wherein the code is a bar code and said input device is a bar code reader.

5. The device as defined in claim 2, wherein the code includes price information, and wherein said input device is a cash register.

6. A method for the detection and deactivation of a deactivatable security element fitted in or affixed to an article for the purpose of electronic article surveillance, comprising the steps of:

allocating a code with article information to each article;

providing as part of the article information an indication as to whether the subject article is protected against pilferage by an electronic security element, and as to the type of security element with which the subject article is equipped;

reading in the code at an input device;

switching on a deactivation unit when the article information allocated to each article indicates that the subject article is protected by the electronic security element; and switching on the deactivation unit in response to the type of security element.

7. A method for the detection and deactivation of a deactivatable security element affixed to an article for the purpose of electronic article surveillance, comprising the steps of:

allocating a code to each article, the code being provided with article information by a processor;

providing as part of the article information an indication as to whether the subject article is protected against pilferage by an electronic security element, and as to the type of security element with which the subject article is equipped;

saving the article information in a storage unit;

reading in the code at an input device;

detecting from the article information whether the article is equipped with an electronically detectable security element;

switching on a deactivation unit when the processor detects that the subject is equipped with the electronically detectable security element; and switching on the deactivation unit in response to the type of security element.

* * * * *